US011833651B2

(12) United States Patent
Paulsen et al.

(10) Patent No.: US 11,833,651 B2
(45) Date of Patent: Dec. 5, 2023

(54) HAMMER WITH HARDENED TEXTURED STRIKING FACE

(71) Applicant: Milwaukee Electric Tool Corporation, Brookfield, WI (US)

(72) Inventors: Alexander J. Paulsen, Milwaukee, WI (US); Christopher T. Larson, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 587 days.

(21) Appl. No.: 16/784,865

(22) Filed: Feb. 7, 2020

(65) Prior Publication Data

US 2020/0254599 A1 Aug. 13, 2020

Related U.S. Application Data

(63) Continuation of application No. PCT/US2020/017047, filed on Feb. 6, 2020.

(60) Provisional application No. 62/802,434, filed on Feb. 7, 2019.

(51) Int. Cl.
*B25D 1/04* (2006.01)
*B25D 1/02* (2006.01)

(52) U.S. Cl.
CPC . *B25D 1/04* (2013.01); *B25D 1/02* (2013.01)

(58) Field of Classification Search
CPC ..... B25D 1/04; B25D 1/02
USPC ..... 81/20; 254/26 R
See application file for complete search history.

(56) References Cited

U.S. PATENT DOCUMENTS

| | | | | |
|---|---|---|---|---|
| 3,130,762 | A | 4/1964 | Kerr | |
| 3,148,716 | A | 9/1964 | Vaughan, Jr. | |
| 3,640,324 | A * | 2/1972 | Porter | B25D 1/00 81/20 |
| 3,721,282 | A | 3/1973 | Hayes et al. | |
| 3,807,804 | A | 4/1974 | Kniff | |
| 4,200,130 | A * | 4/1980 | Reamy | B25D 1/04 81/20 |
| 4,336,832 | A * | 6/1982 | Poulos | B25D 1/04 81/20 |
| 5,996,442 | A | 12/1999 | Carmien | |
| 6,016,722 | A | 1/2000 | Gierer et al. | |
| 6,128,977 | A | 10/2000 | Gierer et al. | |
| D436,821 | S | 1/2001 | Douglas et al. | |

(Continued)

FOREIGN PATENT DOCUMENTS

| | | |
|---|---|---|
| KR | 10-0528699 | 11/2005 |
| TW | D181364 | 2/2017 |
| WO | WO 01-23148 | 4/2001 |

OTHER PUBLICATIONS

International Search Report and Written Opinion for International Application No. PCT/US2020/017047, dated Jun. 11, 2020, 12 pages.

(Continued)

*Primary Examiner* — Hadi Shakeri
(74) *Attorney, Agent, or Firm* — Reinhart Boerner Van Deuren s.c.

(57) ABSTRACT

A tool, such as a hammer, including cladding on a striking surface is shown and described. The cladding interfaces against the object struck by the hammer, thus protecting the hammerhead body from wear. In one embodiment, the cladding comprises multiple separate cladding projections that are affixed to the striking surface.

17 Claims, 6 Drawing Sheets

(56) References Cited

U.S. PATENT DOCUMENTS

| | | | | |
|---|---|---|---|---|
| 6,176,156 | B1 * | 1/2001 | Coonrad | B25D 1/00 81/20 |
| 6,227,075 | B1 | 5/2001 | Carmien | |
| 6,234,048 | B1 | 5/2001 | Carmien | |
| D452,126 | S | 12/2001 | Hung | |
| 6,435,059 | B1 | 8/2002 | Martinez | |
| 6,457,384 | B1 | 10/2002 | Cox et al. | |
| 6,463,832 | B1 | 10/2002 | Cox et al. | |
| D470,380 | S | 2/2003 | Huang | |
| 6,536,308 | B1 | 3/2003 | Thorne et al. | |
| D474,667 | S | 5/2003 | Hung | |
| 6,595,087 | B2 | 7/2003 | Whalen et al. | |
| 6,619,408 | B1 | 9/2003 | Lai | |
| 6,763,747 | B1 | 7/2004 | Gierer et al. | |
| D519,348 | S | 4/2006 | Chen | |
| D549,064 | S | 8/2007 | Youngren et al. | |
| D605,922 | S | 12/2009 | Reinius | |
| 7,874,231 | B2 | 1/2011 | Hanlon | |
| 7,950,308 | B2 | 5/2011 | Atsumi et al. | |
| 8,047,099 | B2 | 11/2011 | St. John et al. | |
| 8,056,443 | B2 | 11/2011 | Hanlon | |
| 8,104,379 | B2 | 1/2012 | Hanlon | |
| 8,141,458 | B1 | 3/2012 | Spencer et al. | |
| 8,164,045 | B2 | 4/2012 | Troxell et al. | |
| 8,261,634 | B2 | 9/2012 | St. John et al. | |
| 8,387,486 | B2 | 3/2013 | Hanlon | |
| 8,479,612 | B2 | 7/2013 | Sergyeyenko et al. | |
| 8,499,665 | B2 | 8/2013 | St. John et al. | |
| 8,534,643 | B2 | 9/2013 | Lombardi et al. | |
| 8,770,548 | B2 | 7/2014 | Hanlon | |
| 8,833,207 | B2 | 9/2014 | Hanlon | |
| D716,126 | S | 10/2014 | Dahlberg | |
| 8,893,585 | B2 | 11/2014 | Descombes et al. | |
| 9,168,648 | B2 | 10/2015 | Lombardi | |
| D742,712 | S | 11/2015 | Zhang et al. | |
| 9,193,059 | B2 | 11/2015 | Lombardi et al. | |
| D747,943 | S | 1/2016 | Hung | |
| 9,233,462 | B2 | 1/2016 | LaPorte | |
| D748,447 | S | 2/2016 | Hung | |
| D770,254 | S | 11/2016 | Honadel et al. | |
| D770,255 | S | 11/2016 | Honadel et al. | |
| D770,875 | S | 11/2016 | Honadel et al. | |
| D777,549 | S | 1/2017 | Hung | |
| D781,123 | S | 3/2017 | Chen | |
| D781,124 | S | 3/2017 | Chen | |
| D789,760 | S | 6/2017 | Hung | |
| 9,789,597 | B2 | 10/2017 | West et al. | |
| 9,802,304 | B2 | 10/2017 | West et al. | |
| D826,024 | S | 8/2018 | Yu | |
| 2005/0229322 | A1 | 10/2005 | Chiu et al. | |
| 2005/0252345 | A1 | 11/2005 | Carmien et al. | |
| 2008/0053278 | A1 | 3/2008 | St. John et al. | |
| 2008/0210059 | A1 | 9/2008 | Adams et al. | |
| 2009/0056504 | A1 | 3/2009 | Atsumi et al. | |
| 2010/0116096 | A1 | 5/2010 | Hanlon | |
| 2010/0154598 | A1 | 6/2010 | Sergyeyenko et al. | |
| 2010/0199809 | A1 | 8/2010 | St. John et al. | |
| 2010/0200737 | A1 | 8/2010 | Troxell et al. | |
| 2010/0224031 | A1 | 9/2010 | Hanlon | |
| 2011/0079111 | A1 | 4/2011 | Hanlon | |
| 2011/0120270 | A1 | 5/2011 | Lombardi et al. | |
| 2011/0314970 | A1 | 12/2011 | Chen | |
| 2012/0036965 | A1 | 2/2012 | St. John et al. | |
| 2012/0085983 | A1 | 4/2012 | Hanlon | |
| 2012/0091409 | A1 | 4/2012 | Hanlon | |
| 2012/0112144 | A1 | 5/2012 | Hanlon | |
| 2012/0119173 | A1 | 5/2012 | Hanlon | |
| 2012/0152066 | A1 | 6/2012 | Descombes et al. | |
| 2013/0126807 | A1 | 5/2013 | Lombardi et al. | |
| 2013/0126808 | A1 | 5/2013 | Lombardi et al. | |
| 2014/0001426 | A1 | 1/2014 | Lombardi et al. | |
| 2014/0165787 | A1 | 6/2014 | Lombardi | |
| 2014/0259695 | A1 | 9/2014 | Guynn et al. | |
| 2015/0068366 | A1 | 3/2015 | Lombardi et al. | |
| 2015/0107417 | A1 | 4/2015 | LaPorte | |
| 2015/0143959 | A1 | 5/2015 | Lin | |
| 2015/0251303 | A1 | 9/2015 | Flosi et al. | |
| 2016/0039078 | A1 | 2/2016 | West | |
| 2017/0297189 | A1 | 10/2017 | Lombardi | |
| 2018/0001458 | A1 | 1/2018 | West et al. | |

OTHER PUBLICATIONS

Oerlikon Metco, Product Data Sheet, Martensitic Matrix Hardfacing Alloy with Fine Scale, Extremely Hard Molybdenum Borides and Vanadium Carbides (Vecalloy 600), 2017, 6 pages.

* cited by examiner

HAMMER WITH HARDENED TEXTURED STRIKING FACE

CROSS-REFERENCE TO RELATED PATENT APPLICATION

This application is a continuation of International Application No. PCT/US2020/017047, filed Feb. 6, 2020, which claims the benefit of and priority to U.S. Application No. 62/802,434, filed Feb. 7, 2019, which are incorporated herein by reference in their entireties.

BACKGROUND OF THE INVENTION

The present disclosure relates generally to the field of tools. The present disclosure relates specifically to a hammer with a hardened and textured striking surface, such as a cladded and milled striking surface.

Hammers are used to strike objects, such as striking a nail into a wooden board. Hammers commonly include a striking surface that is either smooth or textured. An advantage of a textured striking surface is that the striking surface has a stronger purchase on the object being struck and thus is less likely to slip. This can be helpful when quickly hammering in nails at an angle.

SUMMARY OF THE INVENTION

In general, the disclosure described herein relates to a textured-face hammer with a hardened striking surface layer or hard facing layer. The hard facing layer, such as cladding, is formed from a material with improved mechanical properties, such as wear resistance, strength, or toughness, than the main body of the hammer head. The hammerhead is made of suitable material, such as steel, a titanium allow and/or an aluminum allow, and the cladding on the striking surface is made of a different material, such as stronger material with a hardness greater than 60 HRC. Many materials are suitable for this application, for example alloys marketed under the tradenames Metco 1030, Metco 8224, Vecalloy 600, other metal matrix composites (MMC), alloys, ceramics, or tungsten carbide. A non-limiting list of alloy coatings includes cobalt chrome, nickel chrome, tungsten carbide, chromium carbide, vanadium carbide, silicon carbide, carbide, boron nitride, titanium nitride, and silicon nitride, and a non-limiting list of ceramic coatings includes aluminum oxide, titanium oxide, zirconium oxide, and chromium oxide. In various embodiments tungsten carbide, chromium carbide, vanadium carbide, silicon carbide, carbide, boron nitride, titanium nitride, silicon nitride, aluminum oxide, titanium oxide, zirconium oxide, and chromium oxide are used as reinforcement materials in an MMC with the matrix comprising steel, aluminum, magnesium, titanium, cobalt and/or nickel.

In one embodiment, a handheld tool comprises a handle, a body rigidly coupled to the handle, and a hammerhead body rigidly coupled to the body. The hammerhead body is made of a material having a first set of mechanical properties, such as wear resistance, and comprises a striking surface. The striking surface comprises a plurality of projections that individually comprise a cladding affixed to a base. The cladding is made of a second material with improved mechanical properties compared to the first material, such as being more wear resistant than the first material.

In one embodiment, a given projection has a lateral width and vertical height measured from depressions in the striking surface of the hammerhead. The lateral width is measured along a plane parallel to the striking surface and the vertical height is measured along an axis perpendicular to that plane. The cladding on the projection extends from the tip of the projection towards the depressions. In one general embodiment, the lateral width of the cladding on a given projection is between 50% and 100% of the lateral width of the projection, and the vertical height of the cladding is between 10% and 500% of the vertical height of the projection. More specifically, the width of the cladding is between 60% and 95% of the lateral width of the projection, and the height of the cladding is between 60% and 95% of the vertical height of the projection. More specifically, the width of the cladding is between 70% and 92% of the width of the projection, and the height of the cladding is between 70% and 90% of the height of the projection. Even more specifically, the width of the cladding is between 80% and 90% of the width of the projection, and the height of the cladding is between 75% and 85% of the height of the projection.

In one embodiment a hammer comprises a handle, a shaft rigidly coupled to the handle, and a striking surface. The striking surface comprises a body and a plurality of projections that extend from the body and define a striking surface. The body includes a first material having a first hardness, and the plurality of projections include a second material having a second hardness, with the second hardness being greater (harder) than the first hardness.

In another embodiment, a hammer includes a handle, a shaft rigidly coupled to the handle, a striking structure rigidly coupled to the shaft, and a plurality of projections affixed to the striking structure that defines a striking surface. The plurality of projections define a plurality of valleys between the plurality of projections, with each projection of the plurality of projections including a base made from a first material and a cladding affixed to the base and made from a second material different than the first material. The base defines a first maximum width measured between valleys on opposing sides of the respective projection, the cladding defines a second maximum width measured parallel to the first maximum width. The second maximum width of the cladding is at least 50% of the first maximum width of the projection.

In another embodiment a hammer includes a handle, a shaft rigidly coupled to the handle, a striking structure rigidly coupled to the shaft, and a plurality of projections affixed to the striking structure and that define a striking surface. Each projection of the plurality of projections comprises a base made from a first material and a cladding affixed to the base and made from a second material. Each projection of the plurality of projections defines a first maximum height measured from a valley adjacent the projection to a tip of the projection. The cladding affixed to each projection of the plurality of projections defines a second maximum height parallel to the first maximum height, with the second maximum height of the cladding being at least 10% of the first maximum height of the projection.

DETAILED DESCRIPTION

Referring generally to the figures, various embodiments of a hammer and elements thereof are shown. Various embodiments of the hammer discussed herein include an innovative hardened and textured striking surface, such as a cladding layer on the striking surface of the hammerhead.

As will generally be understood, a hammer includes a head with a striking surface. Generally, the striking surface of a hammer is either smooth or textured. After extended use, the striking surface of a textured hammer may wear, plastically deform, and/or fracture, losing the effectiveness of the texturing. To protect the striking surface, the hammer design discussed herein includes a hard facing layer of material, such as cladding, that has improved mechanical properties, such as being more resistant to wear, than the rest of the hammerhead. Cladding the surfaces of the hammer increases the life of the hammer by improving its mechanical properties, such as wear resistance, strength, and/or toughness. For example, the cladding material is harder and/or more wear resistant than the material that makes up the hammerhead body. The material of the hammerhead body is selected according to its weight, cost, ease of manufacturing, etc.

In one embodiment, the striking surface of the hammerhead is covered in a cladding and then machine-processed to produce a machined striking surface, such as a repeating pattern of square pyramids extending away from the body of the hammerhead. The resultant cladding is a uniform piece covering most or all of the striking surface of the hammer.

In another embodiment, the striking surface of the hammerhead is covered in a cladding and then machine-processed to produce a machined striking surface, such as a milled striking surface. The machine-processing produces multiple individual claddings that each individually cover a single projection on the striking surface of the hammerhead.

In another embodiment, individual cladding projections are affixed to the striking surface of the hammerhead. The multiple cladding projections are affixed in a pattern on the striking surface, such as in non-linear arrangements.

It is contemplated herein that the textured surface of the hammerhead striking surface, such as serrations of the hammerhead striking surface, is created by processes such as, for exemplary purposes only and without limitation, being machined and/or milled. It is also contemplated herein that the hard facing material on the hammerhead striking surface may be any suitable material including, without limitation, cladding.

Figure 1:
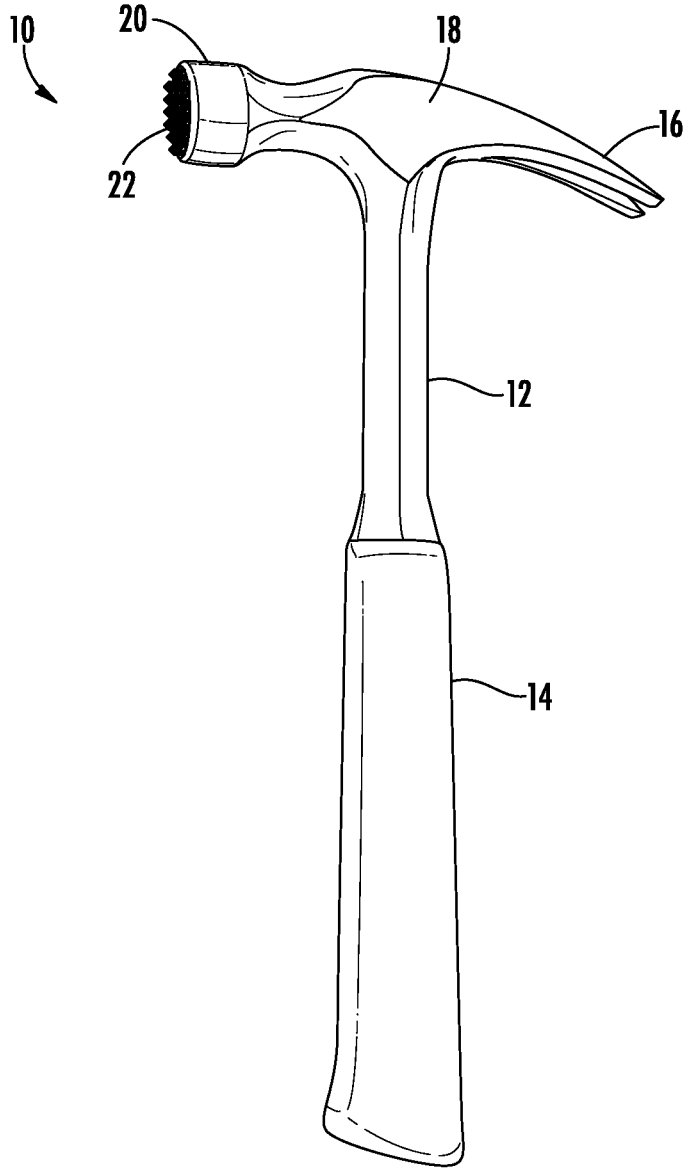
FIG. 1 is a front perspective view of a hammer, according to an exemplary embodiment.
Figure 2:
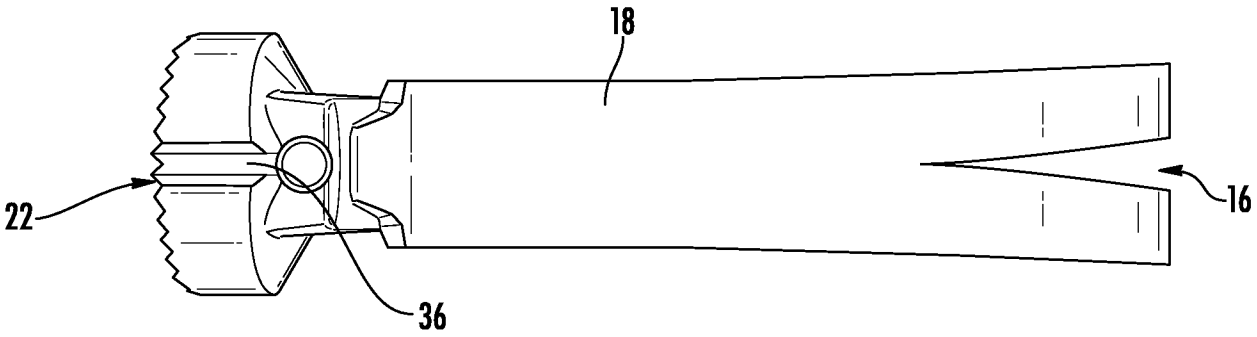
FIG. 2 is a top view of a hammer, according to an exemplary embodiment.

Referring to FIGS. 1-2, a device for striking objects, such as hammer 10, is shown according to an exemplary embodiment. In this exemplary embodiment, hammer 10 comprises handle 14, a shaft or body 12 and head 18. In use, handle 14 is gripped by a user and rotated so that head 18 strikes a desired object. In various embodiments handle 14 is rubber, fiberglass, wood, plastic, steel, titanium and/or aluminum and body 12 is rubber, fiberglass, wood, plastic, steel, titanium and/or aluminum. In various embodiments handle 14 and body 12 are the same material. Body 12 rigidly couples handle 14 and head 18. Head 18 includes striking structure 20 extending from head 18 opposite claw 16. Claw 16 is suitable for prying or gripping a work piece, such as a nail projecting from a board. Striking structure 20 includes striking surface 22, which includes nail starter 36 where a nail can be rested before being initially placed in an object.

Figure 3:
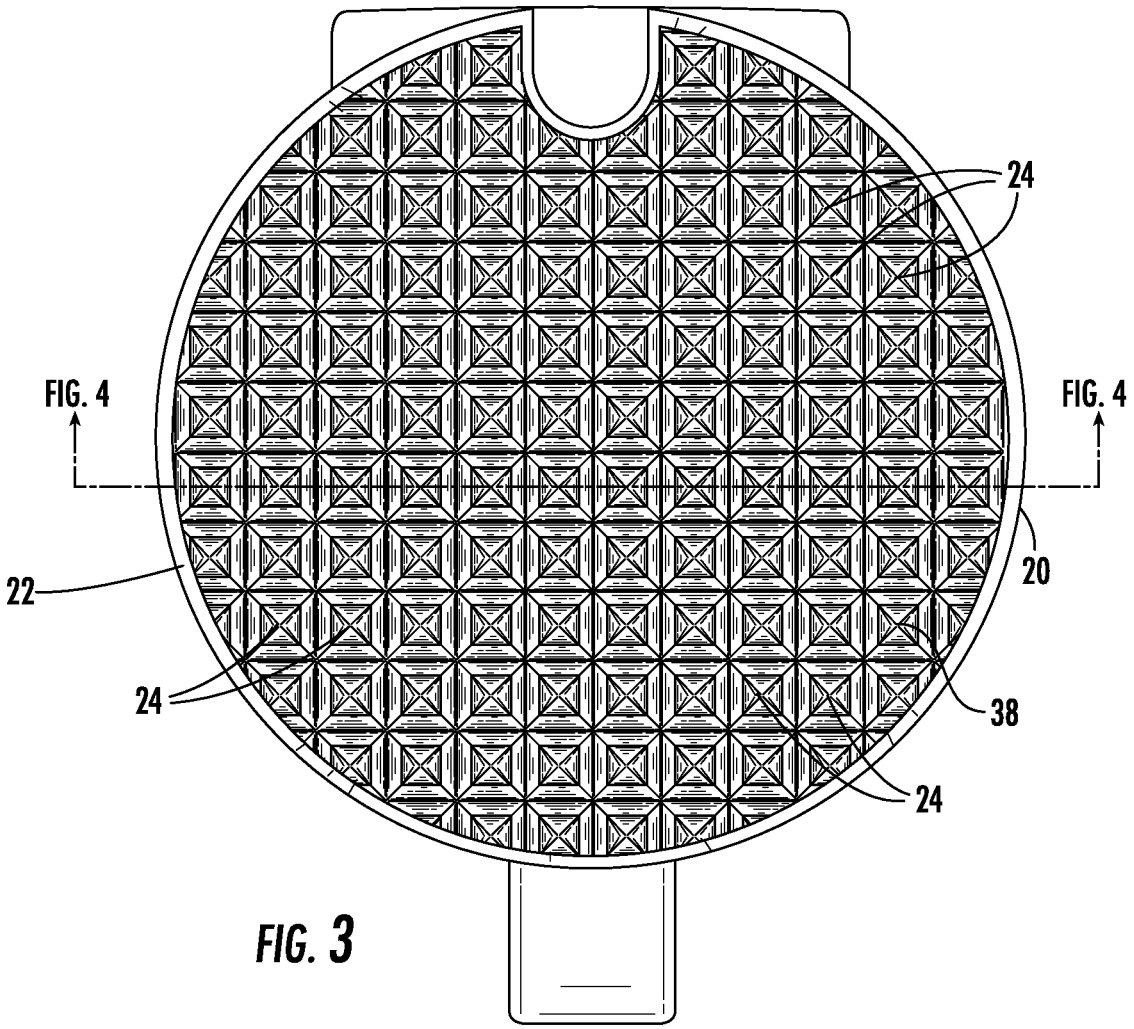
FIG. 3 is a perspective view of the hammer, according to an exemplary embodiment.
Figure 4:
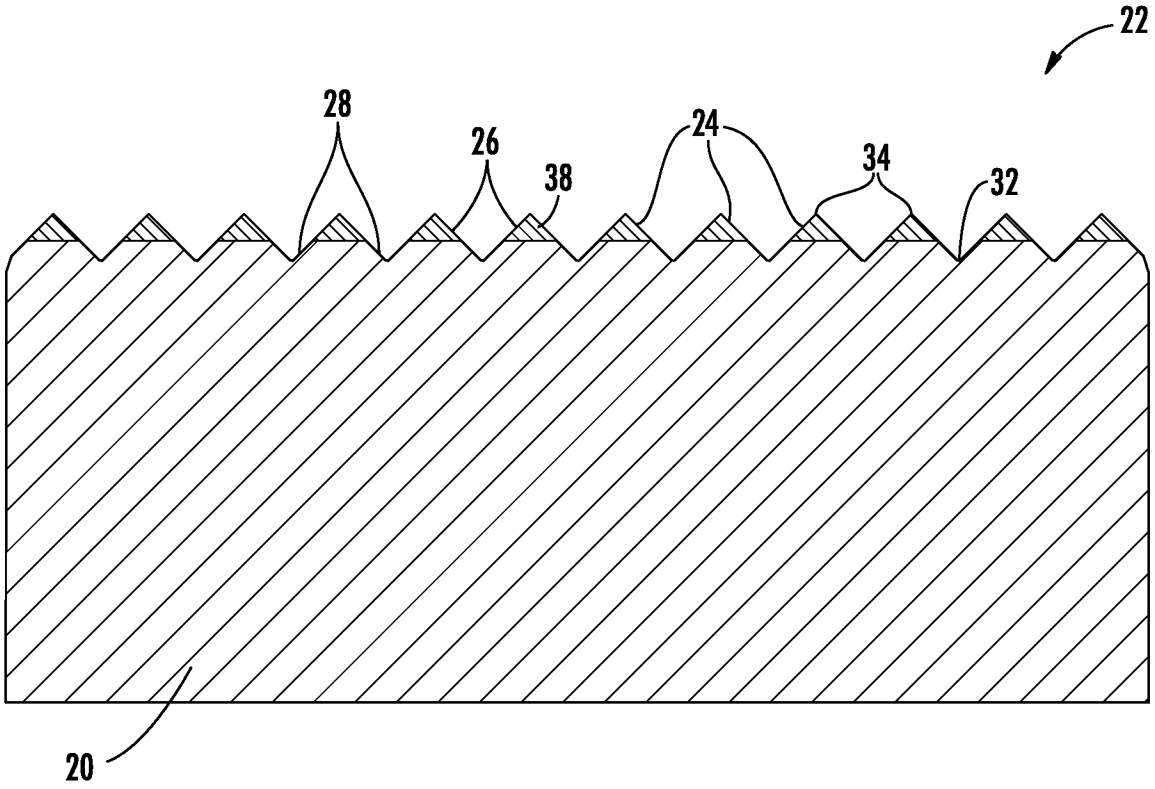
FIG. 4 is a cross-sectional view of the hammer of FIG. 3, according to an exemplary embodiment.
Figure 5:
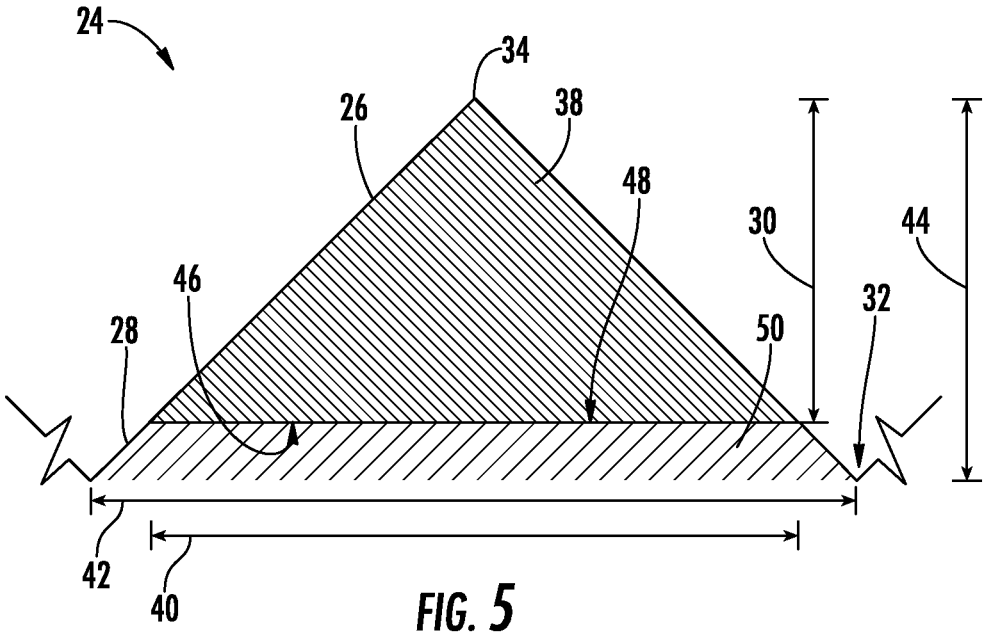
FIG. 5 is a cross-sectional view of an individual cladded tip of the hammer of FIG. 4, according to an exemplary embodiment.

Turning to FIGS. 3-5, striking surface 22 includes multiple projections 24 that extend from striking structure 20. Projections 24 comprise cladding 38 and base 50. Cladding 38 is made of a relatively harder material (e.g., a harder durometer measurement, a Rockwell hardness measurement), such as alloys marketed under the tradenames Metco 1030, Metco 8224 and/or Vecalloy 600, that are more resistant to wear than the material comprising base 50, which is steel or titanium. In various embodiments cladding 38 has a hardness HRC of 63-68. When hammer 10 is being used, cladding 38 interfaces against the object being struck (e.g., a nail), reducing the wear on striking structure 20. In a specific embodiment cladding 38 is the same material as base 50, but cladding 38 is processed so that cladding 38 is harder (e.g., by heat-treating, by normalizing).

Projections 24 include an outer surface, shown collectively as cladding surfaces 26 that are generally coplanar with base surfaces 28. Base surfaces 28 define valleys 32 between projections 24. In one embodiment projection 24 comprises tip 34 that comprises a sharp defined angle between cladding surfaces 26. In another embodiment, tip 34 is a planar surface parallel to base surface 28.

Projection 24 comprises height 44, which includes cladding thickness 30, and width 42, which includes cladding width 40. Cladding width 40 is measured along a plane parallel to striking surface 22 cladding thickness 30 is measured along an axis perpendicular to that plane. In one embodiment, cladding thickness 30 is between 1 mm and 8 mm. More specifically, cladding thickness 30 is between 1.5 mm and 1.7 mm. Even more specifically, cladding thickness 30 is 1.6 mm. In another embodiment cladding thickness 30 is 5 mm.

In a specific embodiment the interface between cladding base surface 46 and top surface 48 of base 50 is planar (e.g., FIG. 5). In various other embodiments, the interface between cladding base surface 46 and top surface 48 of base 50 is non-planar (e.g., curved, undulating).

In one embodiment, the cladding comprises between 50% to 100% of the lateral width and 10% to 500% of the vertical height of the projection. More specifically, the cladding comprises between 60% and 95% of the lateral width and 60% and 95% of the vertical height of the projection. More specifically, the cladding comprises between 70% and 92% of the width and 70% and 90% of the height of the projection. Even more specifically, the cladding comprises between 80% and 90% of the width and 75% and 85% of the height of the projection.

Figure 6:
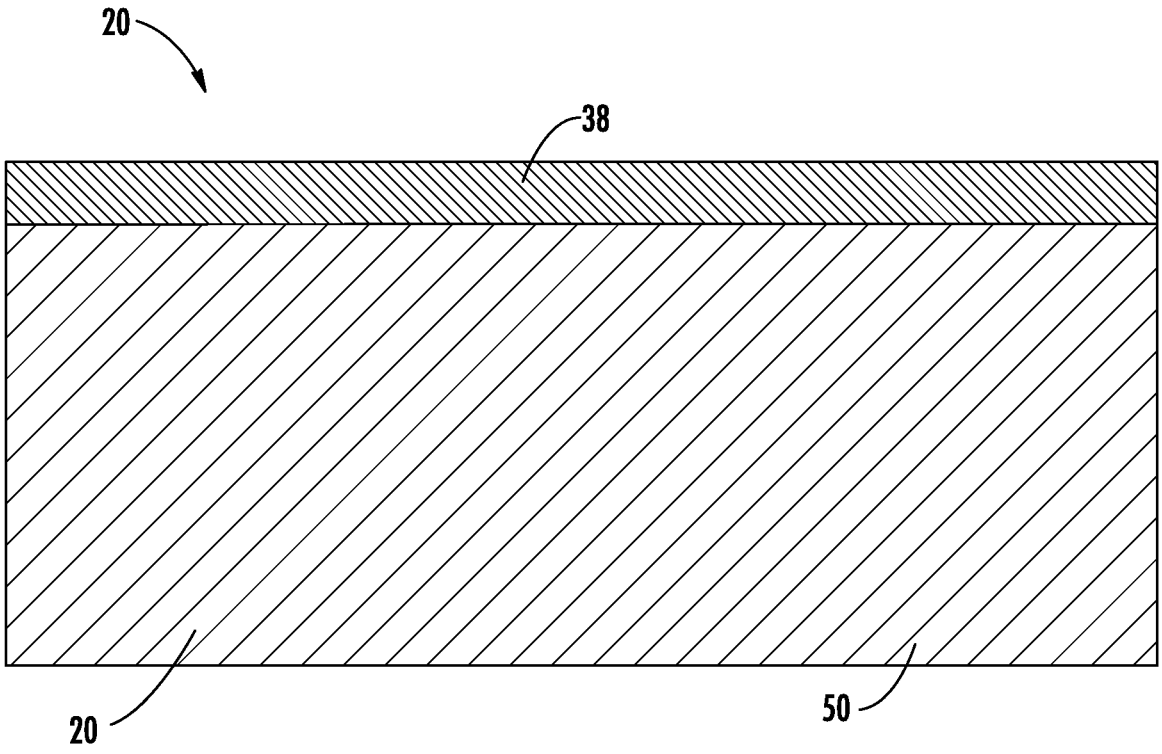
FIG. 6 is a cross-sectional view of a striking face with cladding before being machined, according to an exemplary embodiment.

Hammer 10 may be manufactured using any of several methods. In one method, cladding 38 is affixed to striking surface 22 of striking structure 20 (see FIG. 6). For example, various techniques are used to weld cladding 38 onto striking surface 22, such as TIG, laser welding, arc welding (e.g. gas tungsten arc welding also called tungsten inert gas welding), gas welding (e.g. oxygen-fuel welding), energy beam welding (e.g. laser beam welding), solid-state welding (e.g. explosive welding), thermal spray (e.g. plasma spraying, electric arc spraying, high velocity oxygen-fuel spraying), vapor deposition, plating, and/or conversion coating. In one example, an argon shielding gas carries cladding 38 onto striking structure 20, and a welding procedure (e.g., laser, TIG) fuses cladding 38 to striking structure 20. In alternative embodiments a transition material is used between cladding 38 and base surface 28 to improve adhesion between cladding 38 and striking structure 20.

Cladding 38 is subsequently machined, such as being milled down, to produce projections 24 inside of a tapered edge (best shown FIGS. 1 and 3). In one embodiment, the structure of striking surface 22 is formed using electrical discharge machining (EDM) or any other suitable method. In various other embodiments projections 24 are formed using a machining process (e.g., milling, broaching), abrasive processes (e.g., grinding, lapping, honing), or other processes (e.g., electrical discharge machining, electrochemical machining, laser beam machining).

In one embodiment, the machining process extends past cladding base surface 46 and partially into striking structure 20. In this embodiment, projection 24 comprises cladding surface 26 and base surface 28 (best shown FIGS. 3-5). Projection 24 is depicted as a square-faced pyramid, although other structures for projection 24 are contemplated herein. After cladding 38 is applied, striking structure 20 is heat-treated. In another embodiment the heat treatment occurs before-hand as well as after.

In another embodiment, the machining process only excavates cladding 38 up to cladding base surface 46, leaving projections 24 comprising cladding surface 26 but not base surface 28.

In another embodiment, the machining process only extends partially into the coating leaving a textured pattern affixed to the base.

In another method of manufacture, individual cladding 38 projections 24 are affixed to striking surface 22, such as by use of adhesive between projections 24 and striking surface 22. By this method, base surface 46 of cladding 38 is affixed to top surface 48 of base 50. In one embodiment cladding 38 is affixed to bases 50, creating projections 24 with both cladding surface 26 and base surface 28 (best shown FIG. 5). In another embodiment, projections 24 of cladding 38 are affixed to a generally planar striking surface 22 of base 50 (not shown).

In an illustrative embodiment, both striking surface 22 and claw 16 are clad with cladding 38. It is contemplated herein that striking surface 22 and claw 16 are clad with the same material. It is also contemplated that striking surface 22 and claw 16 are clad with different materials. It is also contemplated herein that only one of striking surface 22 and claw 16 are clad with cladding 38.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the invention relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

What is claimed is:

1. A hammer comprising:

a handle;

a shaft rigidly coupled to the handle;

a striking structure comprising a body and a plurality of projections, the plurality of projections forming a pattern of pyramids that extend from the body and define a striking surface, wherein each projection of the plurality of projections comprises a base made from a first material and a cladding affixed to the base and made from a second material having a second hardness, wherein the second hardness is greater than the first hardness;

wherein each projection of the plurality of projections defines a first maximum height measured from a valley adjacent the projection to a tip of the projection, wherein the cladding affixed to each projection of the plurality of projections defines a second maximum height parallel to the first maximum height, and wherein the second maximum height of the cladding is at least 10% of the first maximum height of the projection; and wherein adjacent projections intersect at a point to define each valley.

2. The hammer of claim 1, wherein the plurality of projections define an outer surface that comprises both the first material and the second material.

3. The hammer of claim 1, wherein the second hardness is between 63-68 HRC.

4. A hammer comprising:

a handle;

a shaft rigidly coupled to the handle;

a striking structure rigidly coupled to the shaft; and a plurality of projections forming a pattern of pyramids that extend from the striking structure and that define a striking surface, the plurality of projections define a plurality of valleys between the plurality of projections, wherein each projection of the plurality of projections comprises a base made from a first material and a cladding affixed to the base and made from a second material different than the first material, wherein the base defines a first maximum width measured between valleys on opposing sides of the respective projection, the cladding defines a second maximum width that is measured parallel to the first maximum width, and wherein the second maximum width of the cladding is at least 50% of the first maximum width of the projection;

wherein each projection of the plurality of projections defines a first maximum height measured from a tip of the projection to a valley adjacent the projection, and wherein the cladding affixed to each projection of the plurality of projections defines a second maximum height measured from the tip of the projection to an outermost surface of the base, and wherein the second maximum height of the cladding is at least 10% of the first maximum height of the projection; and wherein adjacent projections intersect at a point to define each valley.

5. The hammer of claim 4, wherein the base of each projection of the plurality of projections defines a planar top surface that the cladding is affixed to.

6. The hammer of claim 4, wherein the first material has a first hardness, wherein the second material has a second hardness, and wherein the second hardness is greater than the first hardness.

7. The hammer of claim 4, wherein the second maximum width of the cladding is between 60% and 95% of the first maximum width.

8. The hammer of claim 4, wherein the second maximum width of the cladding is less than 85% of the first maximum width.

9. The hammer of claim 4, further comprising a head rigidly coupled to the shaft, the head comprising the striking structure and a claw opposing the striking structure, the claw comprising the second material.

10. A hammer comprising:

a handle;

a shaft rigidly coupled to the handle;

a striking structure rigidly coupled to the shaft; and a plurality of projections affixed to the striking structure and that define a striking surface, wherein each projection of the plurality of projections comprises a base made from a first material and a cladding affixed to the base and made from a second material, wherein each projection of the plurality of projections defines a first maximum height measured from a valley adjacent the projection to a tip of the projection, wherein the cladding affixed to each projection of the plurality of projections defines a second maximum height parallel to the first maximum height, and wherein the second maximum height of the cladding is at least 10% of the first maximum height of the projection, and wherein adjacent projections intersect at a point to define each valley.

11. The hammer of claim 10, wherein the second maximum height is between 1 mm and 8 mm.

12. The hammer of claim 10, wherein the first material has a first hardness, the second material has a second hardness, and wherein the second hardness is greater than the first hardness.

13. The hammer of claim 10, wherein the second maximum height of the cladding is between 60% and 95% of the first maximum height.

14. The hammer of claim 10, further comprising a head rigidly coupled to the shaft, the head comprising the striking structure and a claw opposing the striking structure, the claw comprising the second material, wherein the plurality of projections extend from the striking structure.

15. The hammer of claim 10, wherein each projection of the plurality of projections defines a first maximum width measured between valleys on opposing sides of the projection, and wherein the cladding affixed to each projection of the plurality of projections defines a second maximum width, and wherein the second maximum width is at least 50% of the first maximum width.

16. The hammer of claim 10, wherein the base of each projection of the plurality of projections defines a planar top surface that the cladding is affixed to.

17. The hammer of claim 10, wherein the first material is the same as the second material.

* * * * *